US005221012A

United States Patent [19]

Licari

[11] Patent Number: 5,221,012

[45] Date of Patent: Jun. 22, 1993

[54] EXPANDABLE HANGING RACK

[76] Inventor: Vito Licari, 875 Ocean Ave., Elberon, N.J. 07740

[21] Appl. No.: 780,808

[22] Filed: Oct. 22, 1991

[51] Int. Cl.[5] ..... A47F 5/08

[52] U.S. Cl. ..... 211/105; 248/277

[58] Field of Search ..... 211/105, 202; 403/154, 403/155, 161, 163; 248/277

[56] References Cited

U.S. PATENT DOCUMENTS

| | | | |
|---|---|---|---|
| 132,692 | 10/1872 | Roddy | 211/105 |
| 245,897 | 8/1881 | Watters | 211/105 |
| 2,367,253 | 1/1945 | Williams | 211/105 |
| 2,493,936 | 1/1950 | Williams | 211/105 |
| 3,164,054 | 1/1965 | Biesecker | 403/163 X |
| 3,337,060 | 8/1967 | Artweger | 211/105 |
| 4,287,993 | 9/1981 | Licari | 211/105 |
| 4,488,650 | 12/1984 | Licari | 248/277 X |
| 4,497,413 | 2/1985 | Tocci | 211/105 X |
| 4,655,628 | 4/1987 | Parker | 403/163 |
| 4,750,886 | 6/1988 | Portelli et al. | 403/163 |

*Primary Examiner*—David A. Scherbel
*Assistant Examiner*—Derek J. Berger
*Attorney, Agent, or Firm*—Morton Chirnomas

[57] ABSTRACT

An expanding rack for hanging articles includes a first frame member and a second frame member attached to the first frame member by attaching means, the attaching means comprising a pivotable joint consisting of a male attachment member provided on the first frame member and female receiving means for receiving the male attachment member provided on the second frame member, the male attachment member being undetachably and pivotally secured in the female receiving means by cooperative positive interlocking means, the positive interlocking means being integral with the female receiving means and the male attachment member.

4 Claims, 6 Drawing Sheets

EXPANDABLE HANGING RACK

FIELD OF THE INVENTION

The present invention relates to expandable hanging racks adapted to hang articles therefrom and to expandable hanging racks having pegs attached to a jointed frame comprised of members pivotally attached to one another. More particularly, the present invention relates to expandable hanging racks wherein the frame members are attached to one another by locking means formed integrally with the members.

BACKGROUND OF THE INVENTION

Articles such as coats, hats, towels, drinking mugs, cookware, tools and the like are commonly stored in a more organized fashion on various wall-mounted racks. One very well known form of rack includes pegs extending outwardly from a jointed frame to which they are attached. The joints of this type of frame allow the overall dimension of the frame and the distance between the hooks to be adjusted by permitting the frame s members to move in an accordion-type fashion relative to one another. Such a rack can be adjusted to fit in wide or narrow storage spaces and to accommodate wide and narrow articles. Furthermore, the racks of this type can be completely compacted for increased ease and reduced expense in shipment.

As is more fully elaborated upon in my U.S. Pat. No. 4,287,993 (hereinafter the '993 patent) and 4,488,650 (hereinafter the '650 patent), which patents are hereby incorporated by reference, racks of the type described above were frequently fabricated from a variety of relatively expensive elements, such as wood members, screws or nails, and the like, which necessitated the use of various tools for assembling the racks, as well as numerous fabrication processes to make the elements. My prior patents improved greatly on these older forms by providing a structure whereby a pin joint was constructed by the assembly of three basic components, i.e., one frame member having an open-ended sleeve, another frame member having an integrally formed pin or integrally formed sleeve which is received into the open-ended sleeve and a hook member which holds the two frame members together in a pivotal relationship.

In the track of the '993 patent, the hook member is slid down over that portion of the integrally formed pin protruding through the open-ended sleeve and frictionally engaged thereon, thereby rotatably securing the frame members to one another and presenting a hook from which articles may be hung. However, this structure suffers from the disadvantage in molded plastic embodiments that the hook member, no matter how forcefully hammered into place by an assembler, would frequently become loosened and often disengaged from the protruding pin due to post-assembly contraction of the plastic upon cooling.

Similarly, the rack of the '650 patent is formed by sliding the integral sleeve of one frame member into that of another frame member and rotatably securing the two frame members together by providing the hook member with an integral pin which is inserted into the inner sleeve and held therein by either friction or a mechanical locking device. This arrangement is not advantageous for a number of reasons. Firstly, an article of clothing such as a heavy coat which is hung on the end of the hook member will exert a large amount of force on the integral pin. This can cause an unacceptable amount of product breakage under normal operating conditions and circumstances. Secondly, each joint is comprised of three pieces which must be assembled in an assembly line. Therefore, a ten-hook rack requires the assembly of eighteen components, which is an unnecessarily large number of components. Any reduction in this number of components can result in substantial reductions in the cost of producing the racks.

Additionally, the costs for plastic molding materials have skyrocketed in recent years forcing manufacturers to seek new designs for reducing both assembly costs as well as molding costs. Therefore, any reduction in product density is greatly desired.

OBJECTS AND SUMMARY OF THE INVENTION

Accordingly, it is an object of the present invention to provide an expanding rack for hanging articles that is more easily assembled than known expanding racks.

It is another object of the present invention to provide and expanding rack that is made with the assembly of fewer parts than is possible with known expanding racks.

It is still another object of the present invention to provide an expanding rack that is made with less raw material than known expanding racks.

The aforementioned disadvantages of known expanding racks made of resiliently deformable materials are overcome and the above-mentioned objectives are accomplished by a new and improved adjustable rack which, like my prior racks, comprises pivotally attaching at least two frame members to each other. The structure of the improved rack allows the two frame members to be pivotally attached and securely held together without the need for a separate hook or pin member.

The above-mentioned economy of parts is accomplished in the exemplary embodiment by providing a first frame member with a frusto-conical male attachment member, the male attachment member having at least one projecting bead provided along an outer surface thereof. A second frame member is provided with female receiving means, the female receiving means further comprising a peg member including a free end and a base end region adjacent to the frame member and further including a frusto-conical cavity shaped and sized so as to snugly receive the male attachment member and having its opening in the base end region and extending towards the free end. The cavity is provided with an inner surface having a bottleneck at such a position whereby the projecting bead of the male attachment member is pushed beyond the annular bottleneck when the male attachment member is fully inserted into the female receiving means.

The first frame member and second member are attached simply by inserting the frusto-conical male attachment member into the frusto-conical cavity of the female receiving means far enough so that the resiliently deformable projecting bead provided on the outer on the outer surface of the male attachment member is forced up past the annular bottleneck therein. Thus, a mechanical locking device is achieved preventing unintentional separation of the components of the rack while preserving the rotational capabilities of each joint without the necessity of molding or assembling a separate pin as in my prior racks.

The above and other objects, features and advantages of the present invention will become readily apparent from the following detailed description which is to be read in connection with the accompanying drawings.

BRIEF DESCRIPTION OF THE DRAWINGS

For a more complete understanding of the present invention, reference may be had to the following detailed description considered in conjunction with the accompanying drawings, in which.

DETAILED DESCRIPTION OF THE PREFERRED EMBODIMENTS

While the present invention is applicable to any type of adjustable rack or similar device, it is particularly well suited for use in connection with the type of adjustable rack or similar device, it is particularly well suited for use in connection with the type of adjustable racks disclosed in my prior U.S. Pats. Nos. 4,287,993 and 4,488,650. Therefore, the present invention will be described with particular reference to the type of adjustable racks disclosed in the aforementioned prior patents, the specifications of which are hereby incorporated by reference.

Figure 1:
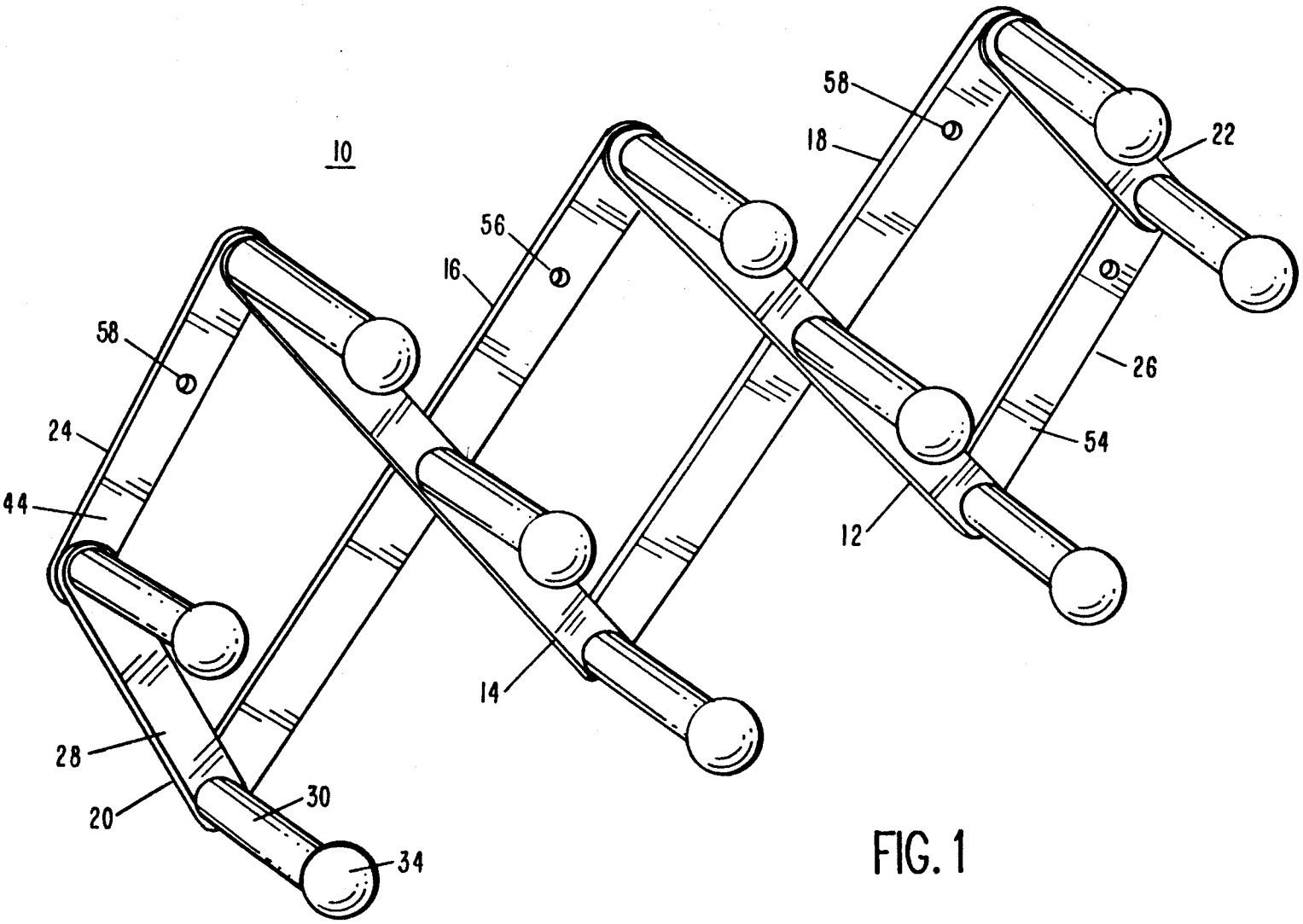
FIG. 1 is a front elevational view of an expanding rack constructed in accordance with the present invention.

With reference to FIG. 1 in particular, an expanding rack 10 constructed in accordance with the present invention is preferably made entirely of a resiliently deformable material such as injection molded plastic, and in particular, pigmented polypropylene, polyethylene, styrene and nylon. Such a rack 10 includes a first pair of inner frame members 12, 14, a second pair of inner frame members 16, 18, a first pair of outer frame members 20, 22, and a second pair of outer frame members 24, 26.

Figure 2:
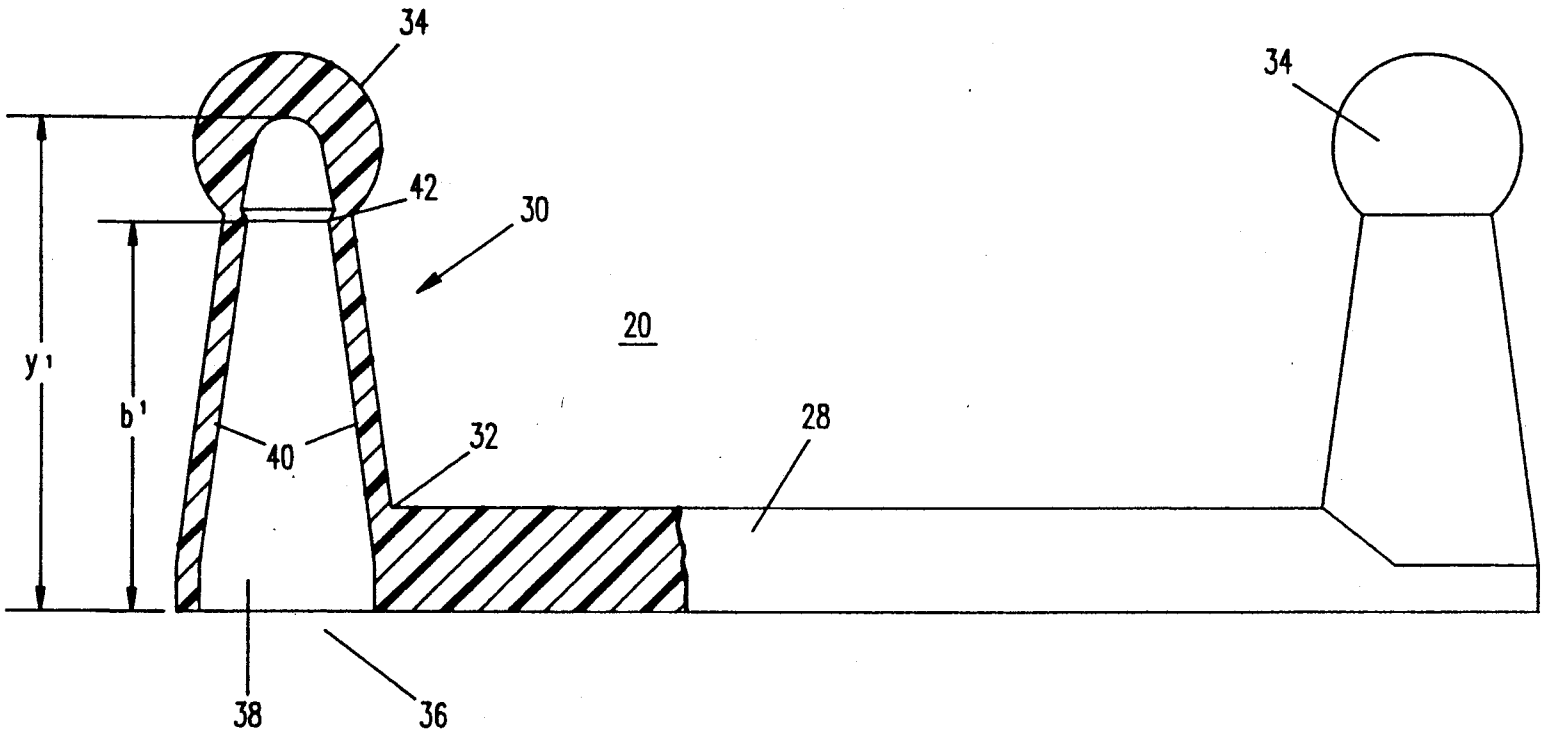
FIG. 2 is a side elevational view of a female receiving member of one exemplary embodiment of the expanding rack illustrated in FIG. 1, a portion thereof being shown in cross-section taken along line II—II of FIG. 1.

Referring now to FIG. 2, there is shown an illustration of outer frame member 20 in detail, outer frame member 22 being virtually identical in structure. The general structure of inner frame members 12, 14, are essentially the same as that of outer frame members 20, 22, differing therefrom in only one substantial aspect as will be described further hereinbelow.

Outer frame member 20 includes a crossbar 28 having peg members 30 extending perpendicularly from either end thereof, peg members 30 being perpendicular to the long axis of crossbar 28 and parallel to one another. Peg members 30 are roughly frusto-conical in shape along their outer surface, having a larger diameter at their base 32 where they are attached to crossbar 28 and narrowing to a smaller diameter farthest away from crossbar 28. Each peg member 30 is provided at its end with an end knob 34 which is shaped so as to its end with an end knob 34 which is shaped so as to provide a catch for any article hanging thereon to prevent it from slipping off the end of peg member 30, thereby giving the peg 30 the appearance of a head above a neck.

In the bottom of base 32, peg member 30 is provided with an opening 36 which leads into a frusto conical cavity 38. Near the closed end of cavity 38, the inner walls 40 abruptly diverge from another for at least a short distance whereby a resiliently deformable bottleneck 42 is formed. The purpose of bottleneck 42 will be further elucidated hereinbelow.

Figure 3:
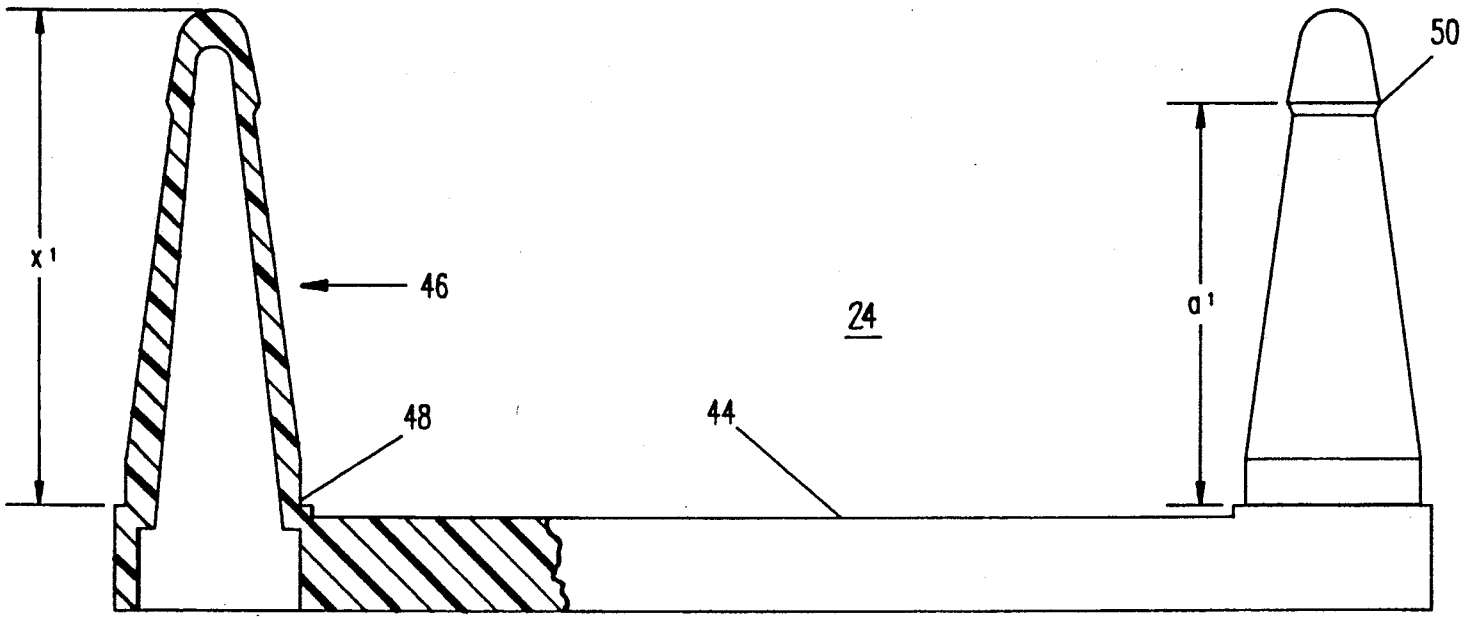
FIG. 3 is a side elevational view of a male attachment member for use with the female receiving member illustrated in FIG. 2 in constructing the expanding rack in accordance with the present invention, a portion thereof being shown in cross-section.

Outer frame member 24, frame member 26 being virtually identical in structure, includes a crossbar 44 having a length equal to the length of crossbar 28 as can be seen by referring to FIG. 3. Frame member 24 has a male attachment member 46 attached to each end of crossbar 44 and extending from either end thereof, the male attachment members 46 being perpendicular to the long axis of crossbar 44 and parallel to one another. Male attachment members 46 are roughly frusto-conical in shape along their outer surface, having a diameter at their base 48 equal to that of opening 36 and extending a height x' from crossbar 44 approximately equal to the depth y' of cavities 38.

Additionally, male attachment members 46 have a diameter corresponding at all points along their lengths with the diameters of cavities 38 in peg members 30. Thus, male attachment members 46 have an annular, deformable bead 50 near their top end, at a height a' above crossbar 44 which is slightly greater than the distance b' from opening 36 to bottleneck 42. Annular bead 50 is provided having a diameter slightly greater than bottleneck 42. The end of male attachment member 46 above annular bead 50 has an ever diminishing diameter farther above annular bead 50.

As mentioned above with reference to FIG. 1, frame members 12, 14 have essentially the same structure as frame members 20, 22. The same is true of frame members 16, 18 with respect to frame members 24, 26. The primary difference between frame members 12, 14 and frame members 20, 22 is that whereas the latter frame members 20, 22 have only a pair (2) of peg members 30, one at either end of each frame member, the former frame members 12, 14 have crossbars 54 which are twice the length of crossbars 28. Therefore, frame members 12, 14 are capable of accommodating thereon three (3) peg members 30, the outer peg members 30 being equidistantly spaced from the centrally positioned peg members 30 along crossbars 54.

Similarly, it can be seen in FIG. 1 that frame members 16, 18 are also provided with crossbars 56 which are twice as long as crossbars 44. Therefore, frame members 16, 18 can accommodate thereon three (3) male attachment members 46, the outer male attachment members 46 being equidistantly spaced from the centrally positioned male attachment members 46 along crossbars 56.

The center-to-center distances between each of peg members 30, and therefore between each of cavities 38, on frame members 12, 14, 20, 22 are preferably the same as the center to center distances between each of male attachment members 46 on frame members 16, 18, 24, 26. Otherwise, when the frame members are arranged according to FIG. I, the resultant expandable rack would have an irregular shape or would be impossible to assemble in a useful manner.

Figure 4:
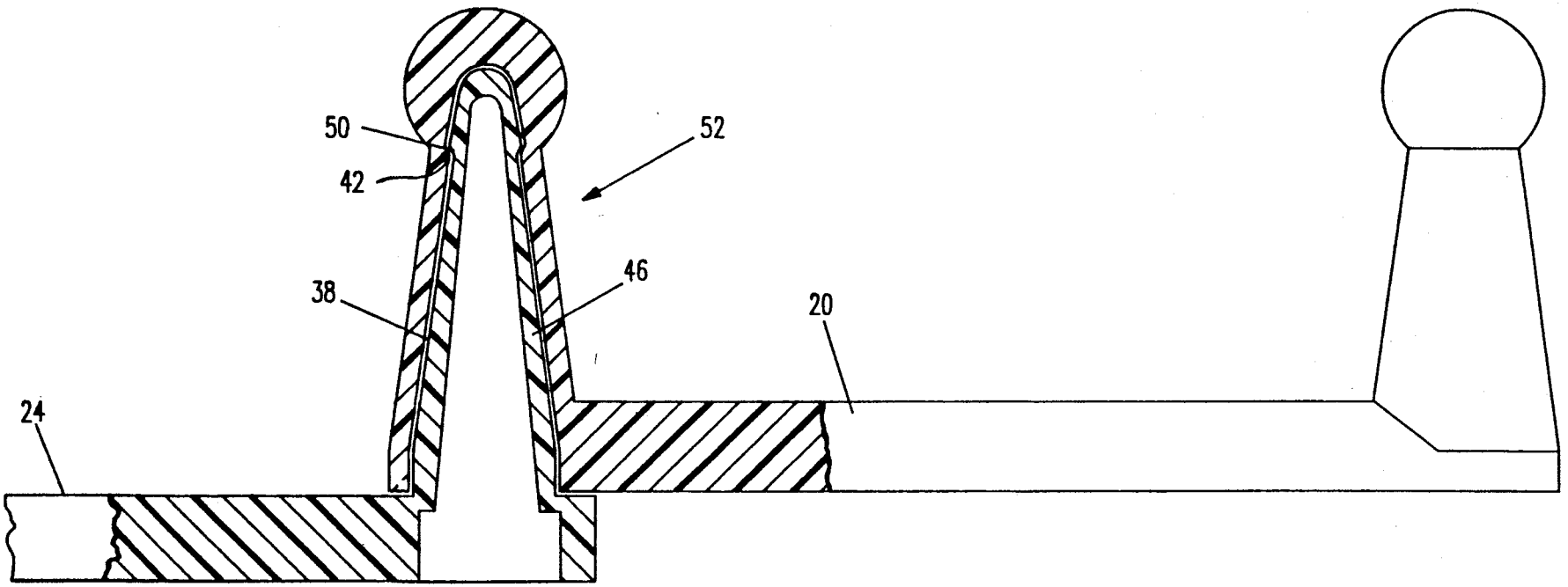
FIG. 4 is a cross-sectional view of a joint of the expanding rack illustrated in FIG. 1 constructed in accordance with the present invention using the female receiving member shown in FIG. 2 and male attachment member shown in FIG. 3.

Referring now to FIG. 4, it can be seen that a rotatable hinge joint 52 is formed when male attachment member 46 is inserted into cavity 38. Bottleneck 42 and deformable bead 50 are so positioned relative to one another that when sufficient force is applied by an assembler on male attachment member 46 then deformable bead 50 is pushed into cavity 38 past bottleneck 42, which is initially resiliently deformed and subsequently reassumes its initial diameter due to its plastic memory. After bottleneck 42 is restored to its original dimensions, male attachment member 46 is effectively locked into place such that only rotational motion of frame member 24 is possible with respect to frame member 20, for example.

In use, the rack 10 can be hung from a vertical support surface by any suitable technique. For instance, the rack 10 could be provided with holes 58 in the crossbars 44, 54, 56, 58 for receiving fasteners, such as screws, for fastening the rack 10 to a wall, door or other vertical support surface.

Figure 5:
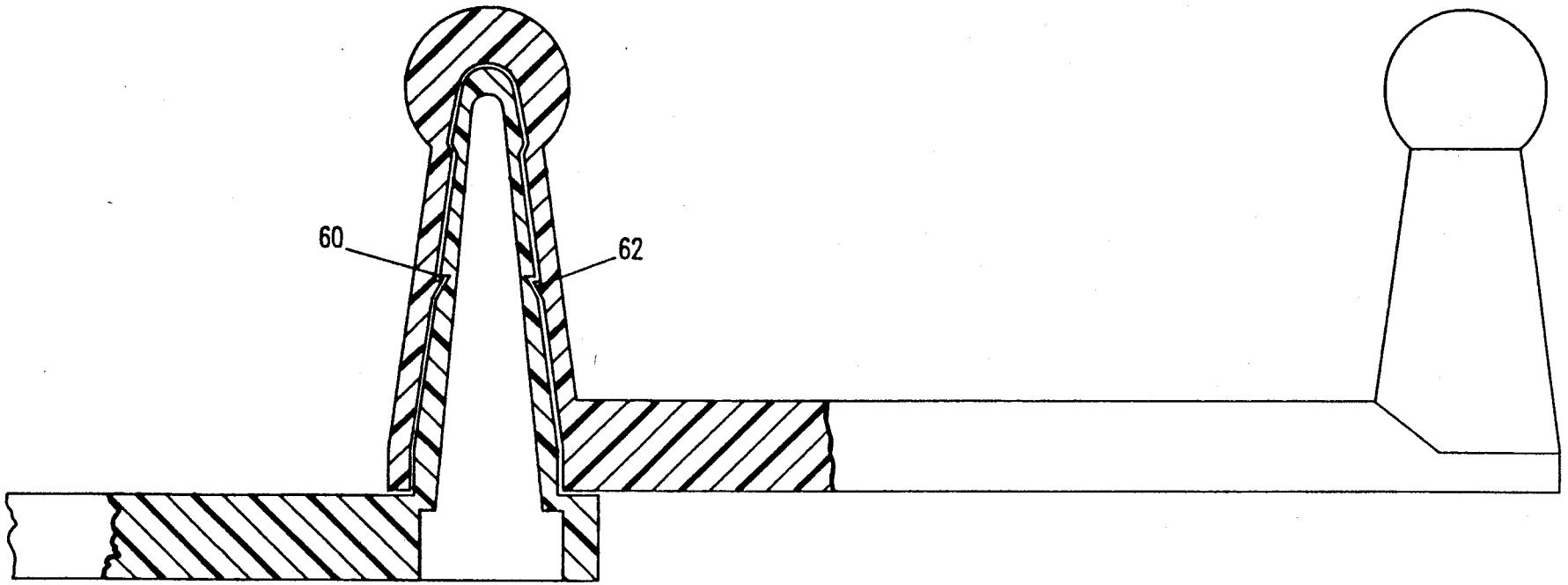
FIG. 5 is a cross-sectional view of a joint of the expanding rack illustrated in FIG. 1 constructed in accordance with another exemplary embodiment of the present invention.
Figure 6:
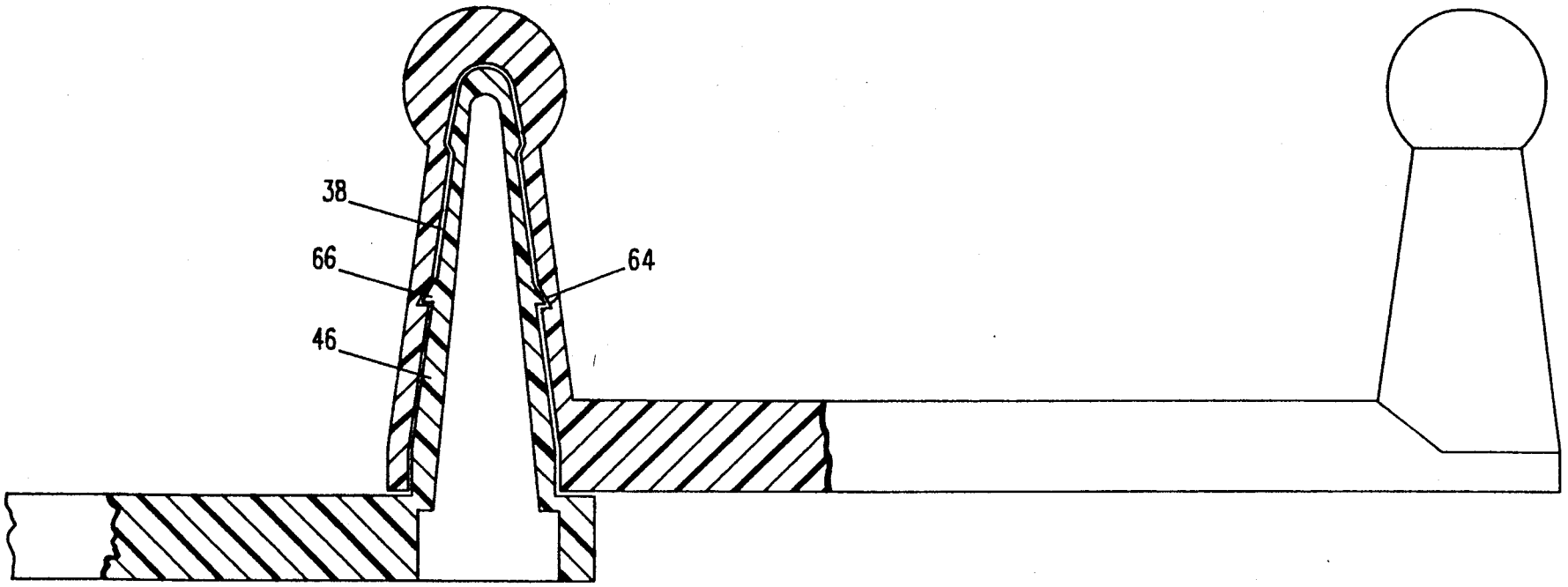
FIG. 6 is a cross-sectional view of a joint of the expanding rack illustrated in FIG. 1 constructed in accordance with another exemplary embodiment of the present invention.

It will be understood that the embodiment described herein is merely exemplary and that a person skilled in the art may make many variations and modifications without departing from the spirit and scope of the invention. For example, as can be seen in FIGS. 5–7, the cooperative positive interlocking means provided by bottleneck 42 and annular bead 50 can be replaced or modified with other cooperative means. Specifically referring to FIG. 5, such alternative locking means could include providing an annular channel 60 in the outer surface of male attachment members 46 in which there is seated a complementary projection 62 provided on the inner surface of each cavity 38. The depth of channel 60 is determined relative to the height of projection 62 such that movement of projection 62 within channel 60 is possible without great difficulty. For example, projection 60 could have a height of about 3/32 inch and channel 60 would thus be provided with a depth of from about 1/16" inch to about 5/64 inch.

FIG. 6 illustrates an exemplary embodiment of an expanding rack utilizing an alternative cooperative locking mechanism wherein the inner surface of each cavity 38 has annular channels 64 formed therein and the outer surface of male attachment members 46 are provided with corresponding beads 66. When a male attachment member 46 is fully inserted into a cavity 38, beads 66 are seated in channels 64. The height of beads 66 relative to the depth of channels 64 is predetermined as above so that the beads will be seated firmly enough to prevent unintentional withdrawal of male attachment member 46 from cavity 38 and yet still allow rotational movement of male attachment member 46 within cavity 38.

It will be understood that the embodiments described herein are merely exemplary and that a person skilled in the art may make many additional variations and modifications without departing from the spirit and scope of the invention. All such modifications and variations are intended to be included within the scope of the invention as defined in the appended claims.

I claim:

1. An expanding rack for hanging articles therefrom, said rack including a first frame member and a second frame member attached to said first frame member by integrally formed attaching means, said attaching means comprising a substantially frustoconical male attachment member provided on said first frame member and a peg member provided on said second frame member, said peg member having a closed, free end and a base end and further having in said base end a frustoconical cavity having a resiliently deformable side wall, said cavity being corresponding shaped and sized for receiving said male attachment member, said male attachment member being undetachably and pivotally secured into said frustoconical cavity by means of one of a first cooperative positive interlocking means formed on the outer surface thereof and a second cooperative positive interlocking means formed on the surface of said resiliently deformable side wall, said first positive interlocking means comprising an annular bead and said second positive interlocking means comprising at least one projection on the surface of said resiliently deformable side wall at a position determined such that said annular bead is forced past said at least one projection when said male attachment member is forcibly inserted into said cavity, whereby a pivotable joint is formed solely by the seating of said male attachment member within said frustoconical cavity.

2. An expanding rack according to claim 1, wherein said annular bead comprises a substantially spherical head having a first diameter and said at least one projection comprises a resiliently deformable bottleneck having a smaller second diameter provided in said cavity at a predetermined position between said free end and said base end such that said head is forced past and said bottleneck when said male attachment member is fully seated in said cavity.

3. An expanding rack for hanging articles therefrom, said rack including a first frame member and a second frame member attached to said first frame member by integrally formed attaching means, said attachment means comprising a substantially frustoconical male attachment member provided on said first frame member and a peg member provided on said second frame member, said peg member having a closed, free end and a base end and further having in said base end a furstoconical cavity having a resiliently deformable side wall, said cavity being correspondingly shaped and sized for receiving said male attachment member, said male attachment member being undetachably and pivotally secured into said frustoconical cavity by means of one of a first cooperative positive interlocking means formed on the outer surface thereof and a second cooperative positive interlocking means formed in the surface of said resiliently deformable side wall, said first positive interlocking means comprising at least one annular bead and said second positive interlocking means comprising at least one annular depression in the surface of said resiliently deformable side wall at a position determined such that said annular bead is seated in said at least one annular depression when said male attachment member is forcibly inserted into said cavity, whereby a pivotable joint is formed solely by the seating of said male attachment member within said frustoconical cavity.

4. An expanding rack for hanging articles therefrom, said rack including a first frame member and a second frame member attached to said first frame member by integrally formed attaching means, said attaching means comprising a substantially frustoconical male attach member member provided on said first frame member and a peg member provided on said second frame member, said peg member having a closed, free end and a base end and further having in said base end a frustoconical cavity having a resiliently deformable side wall, said cavity being correspondingly shaped and sized for receiving said male attachment member, said male attachment member being undetachably and pivotally secured into said frustoconical cavity by means of one of a first cooperative positive interlocking means formed on the outer surface thereof and a second cooperative positive interlocking means formed on the surface of said resiliently deformable side wall, said second cooperative positive interlocking means comprises at least one projection provided on said side wall at a predetermined depth between said free end and said base end and at least one annular depression provided on the outer surface of said male attachment member at a position such that said at least one projection is seated in said at least one annular depression when said male attachment member is fully seated in said cavity, whereby a pivotable joint is formed solely by the seating of said male attachment member within said frustoconical cavity.

* * * * *